United States Patent [19]

Tsubata et al.

[11] Patent Number: 4,721,135

[45] Date of Patent: Jan. 26, 1988

[54] LOOP-FORMING ASSEMBLY FOR WEAVING MACHINE

[75] Inventors: Noritaka Tsubata, Uozu; Ryuichi Murasaki, Toyama; Takao Kanada, Kurobe, all of Japan

[73] Assignee: Yoshida Kogyo K. K., Tokyo, Japan

[21] Appl. No.: 947,055

[22] Filed: Dec. 29, 1986

[30] Foreign Application Priority Data

Dec. 28, 1985 [JP] Japan ..... 60-298526

[51] Int. Cl.[4] ..... D03D 39/20

[52] U.S. Cl. ..... 139/46; 139/48

[58] Field of Search ..... 139/46, 47, 48, 49, 139/50

[56] References Cited

U.S. PATENT DOCUMENTS

| | | | |
|---|---|---|---|
| 2,043,165 | 6/1936 | Hall | 139/47 |
| 3,295,561 | 1/1967 | Erkes | 139/46 |
| 3,450,167 | 6/1969 | Lygo | 139/47 |
| 4,429,722 | 2/1984 | Herzog | 139/48 |

*Primary Examiner*—Henry S. Jaudon

*Attorney, Agent, or Firm*—Hill, Van Santen, Steadman & Simpson

[57] ABSTRACT

An improved loop-forming assembly in a weaving machine for forming a surface fastener tape blank having a multiplicity of warp pile loops formed of loop-forming warp threads comprises: a plurality of parallel spaced lancets; a deflector extending transversely of and over the lancets; and a plurality of pairs of parallel spaced gate hook bars; the lancets, the deflector and the gate hook bars being kept free from one another. The deflector is axially reciprocable for laterally deflecting the threads in eyelets with respect to the lancets, respectively, and the gate hook bars are vertically reciprocable in timed relation to the deflector to lower the thus deflected threads by hook portions alternately at one side and then at the other side of the lancets so as to pass the threads over the lancets in a staggering fashion to form the warp pile loops.

7 Claims, 8 Drawing Figures

LOOP-FORMING ASSEMBLY FOR WEAVING MACHINE

BACKGROUND OF THE INVENTION

1. Field of the Invention

The present invention relates to a loop-forming assembly incorporated in a weaving machine for producing a woven fabric having a multiplicity of warp pile loops formed one side thereof.

2. Prior Art

A known loop-forming assembly in a weaving machine, for instance, as disclosed by Japanese Patent Laid-Open Publication No. 57-14304, comprises a plurality of doup or heddle units each including a pair of vertical guide legs A, A disposed at opposite sides of a loop-forming bar or lancet D in conjunction with a V-shaped needle B loosely slidably received in a pair of guide slots of the guide legs, as illustrated in FIG. 7 of the accompanying drawings. The needle has at its bent portion an eyelet C through which a loop-forming warp thread (not shown) is threaded. The two guide legs A, A descend in alternate turns to lower the needle B to bring down the loop-forming warp thread alternately to one side and then to the opposite side of the lancet D so as to pass the thread over the lancet D, and thus forming a loop of the thread.

The conventional assembly has a drawback in that it cannot cope with the trend of a high speed weaving machine because the guide legs A and the neddle B operate through mutual physical contact. Another but not smaller problem is that the prior assembly requires a pair of guide legs or wires and a needle per loop-forming bar, which means a increased number of component parts and hence so much complex device as a whole.

SUMMARY OF THE INVENTION

It is therefore an object of the present invention to provide a loop-forming assembly which is simple in construction having a reduced number of components as compared with the conventional counterpart.

Another object of the present invention is to provide a loop-forming assembly which is capable of following a relatively high speed operation of a weaving machine.

According to the invention, a loop-forming assembly incorporated in a weaving machine for producing a woven fabric having a multiplicity of warp thread loops formed on one side thereof comprises a comb-shaped lancet assembly including a plurality of parallel spaced lancets or loop-forming bars each extending between and in parallel with respective adjacent pairs of ground warp threads, an unitary deflector extending transversely of the lancets and including a plurality of eyelets for receiving the loop-forming threads therethrough, and a gate hook assembly positioned downstream of the deflector and including successive pairs of parallel gate hook bars between which each lancet is freely interposed.

The deflector is reciprocably movable in a substantially axial direction for deflecting the course of the loop-forming warp threads in the respective eyelets alternately to one and the other sides of each of the lancets. The paired gate hook bars are vertically reciprocally movable in timed relation to the deflector to capture and lower the deflected threads alternately to opposite sides of the lancets. This combined operation of the deflector and the hook bars passes the loop-forming threads over the lancets in a staggering fashion to provide pile loops on a woven fabric.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
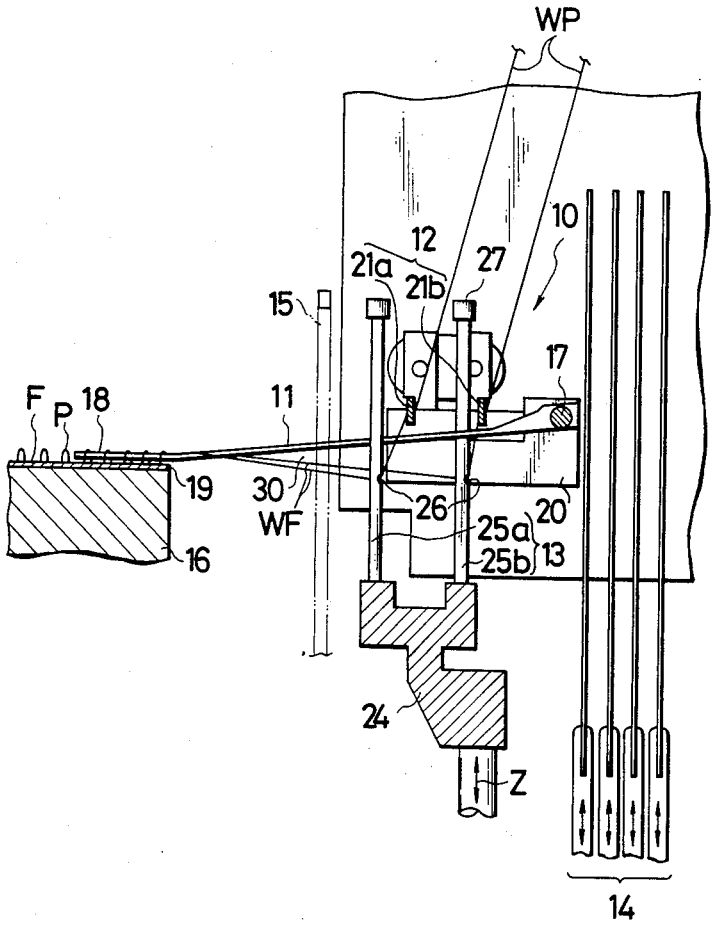
FIG. 1 is a schematic side elevational view, partly sectional, of primary parts of a loop-forming assembly according to one embodiment of the present invention.

A loop-forming assembly generally designated by 10 constructed according to one embodiment of the present invention comprises a substantially comb-shaped lancet unit 11, a leno deflector 12 extending transversely of the lancet unit, and a gate hook unit 13 disposed immediately forwardly (or leftwardly as viewed in FIG. 1) of the deflector. The loop-forming assembly 10 is incorporated in a weaving machine having a heddle unit or harness 14 for forming a shed of ground warp threads (not shown), a reed 15 for beating up a weft thread, and a table 16 for supporting a woven fabric F. More specifically, the loop-forming assembly 10 is located between the harness 14 and the reed 15 as shown in FIG. 1.

A woven fabric produced by the weaving machine is provided with loops formed of an extra set of warp threads in the loop-forming assembly. The woven fabirc referred to herein finds a particular application for a surface fastener or loop-and-hook fastener.

Figure 2:
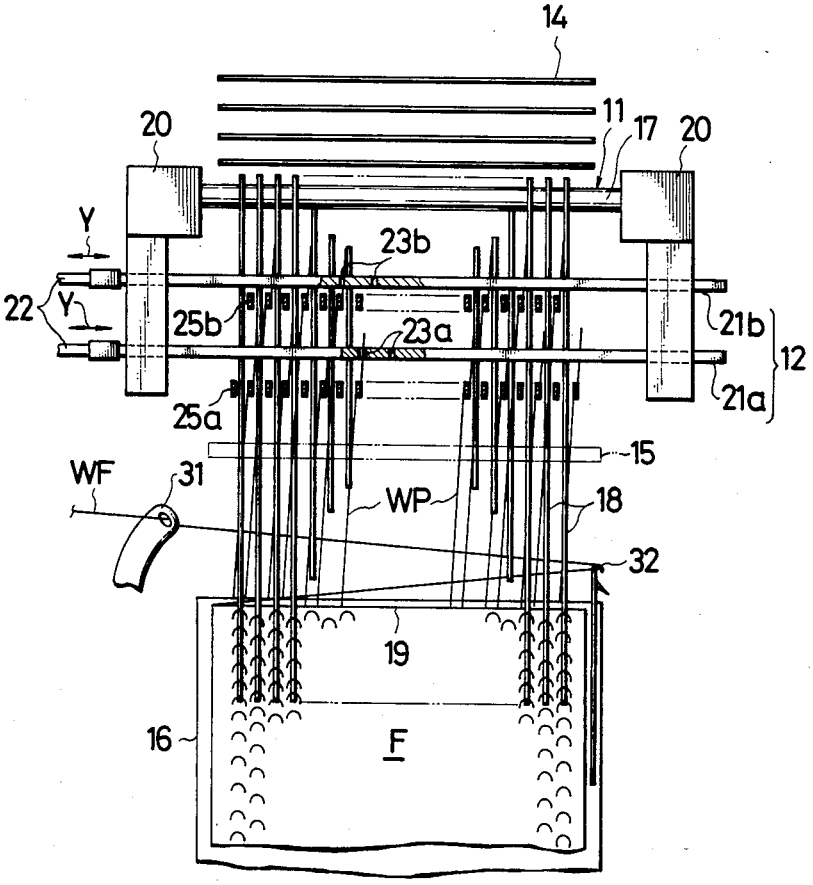
FIG. 2 is a schematic plan view of the assembly of FIG. 1 with portions of the lancets omitted.

As better shown in FIG. 2, the comb-shaped lancet unit 11 includes a support bar 17 extending transversely of the ground warp threads, and a plurality of parallel spaced lancets or bars 18 extending from the support bar 17 in between respective adjacent pairs of the ground warp threads and reaching the woven fabric F beyond a cloth fell 19. The support bar 17 is secured at opposite ends to a guide block 20.

The leno deflector 12 is disposed between the harness 14 and the reed 15, and includes a pair of front and rear guide bars **21*a*, 21*b* extending in parallel with and transversely of the lancets 18. The guide bars 21*a*, 21*b* extend through the guide block 20, and are driven by a power source (not shown) via piston rods 22 connected at respective one ends of the block 20 to move substantially axially in a reciprocating manner, as shown by the arrows Y. Each guide bar has a series of eyelets 23a, 23b through which loop-forming warp threads WP are threaded as shown in FIGS. 1 and 2. Reciprocal movement of the guide bars 21a, 21b causes the loop-forming warp threads WP received in the eyelets 23 to be deflected alternately to one side and then to the opposite side of the lancets 18. The front guide bar 21a has a plurality of eyelets 23a for receiving and deflecting a given even number group of threads WP with respect to corresponding ones of lancets 18, and the rear guide bar 21b has a plurality of eyelets 23b for receiving and deflecting an odd number group of the threads WP with respect to coresponding ones of lancets 18**.

The gate hook unit 13 includes a support block 24 and a plurality of pairs of parallel spaced gate hook bars 25a, 25b extending upwardly from the suppport block 24. Every gate hook bar 25a, 25b has a guide recess 26 for receiving the thread WP. The paired gate hook bars are divided into two groups, one or first group oparatively associated with the front guide bar 21a and the other or second group with the rear guide bar 21b. The first and second groups of the gate hook bars 25a, 25b are disposed downstreamly of the guide bar 21a, 21b respectively and each pair of the hook bars are disposed at the opposite sides of the corresponding lancet 18. Importantly, the gate hook bars 25a, 25b, the lancets 18 and the guide bars 21a, 21b, are always spaced apart one from another. The first group of the paired gate hook bars 25a is assigned for alternate ones of the lancets 18 together with the front guide bar 21a, and the other group of the paired gate hook bars 25b is assigned for the remaining ones of the lancets 18 together with the rear guide bar 21b as best shown in FIG. 2. This arrangement again serves to avoid an objectionable mutual interference of the respective operative parts. The support block 24 is vertically movable to reciprocate the two groups of the gate hook bars 25a, 25b simultaneously in timed relation to the guide bars 21a, 21b, in the direction of the arrows Z.

Figure 3:
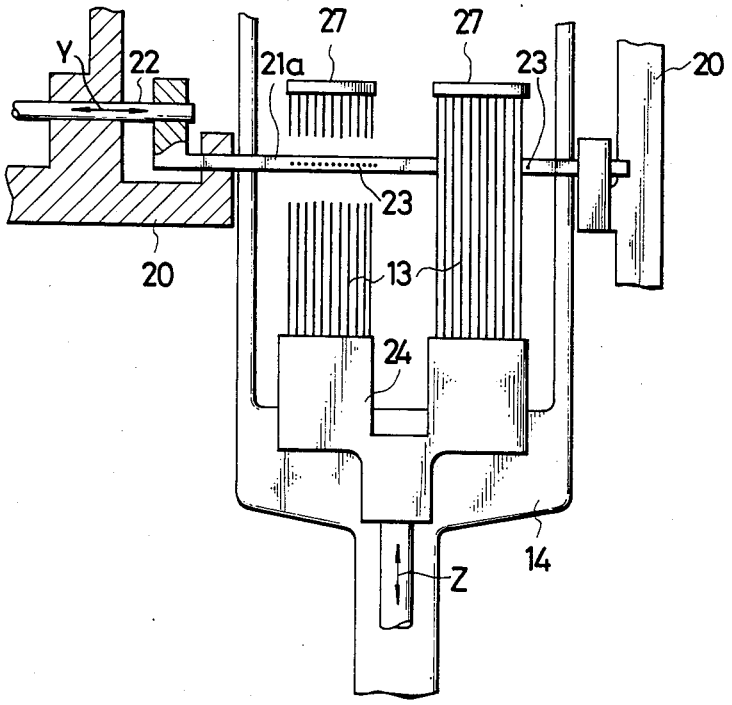
FIG. 3 is a front elevational view of a leno deflector and a gate hook assembly both incorporated in a loop-forming assembly according to another embodiment of the invention.

FIG. 3 shows another embodiment of the invention, in which a double units 13,13 of the gate hook bars are provided side by side to produce two parallel webs of tape F at a time.

The operation of the loop-forming assembly 10 thus constructed is described hereinbelow with reference to FIGS. 4A, 4B in which only a single loop-forming unit of the assembly is shown for the purposes of clarity as any one of these units operates in a similar manner.

Figure 4A:
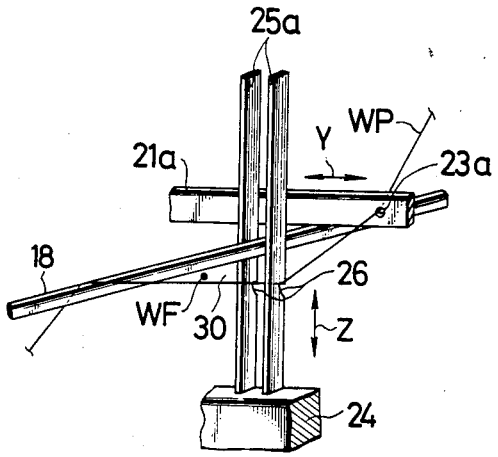
FIGS. 4A and 4B are schematic perspective views each illustrating an individual loop-forming unit consisting of a pair of gate hook bars, a corresponding eyelet and a lancet.

The beat-up operation of the reed 16 is followed by axial movemment of the guide bar 21a, 21b of the deflector 12 in one or rightward direction 9 (as viewed in FIG. 4A) until it reaches the position shown in FIG. 4A in which the eyelet 23a has passed completely across the lancet 18 so that the loop-forming warp thread WP is deflected to one or right-hand side of the lancet 18.

The paired gate bars 25a are lowered to capture the thus deflected thread at the guide recess 26 of the right-hand gate hook bar 25 and move the same down to the right-hand position shown in FIG. 4A below the level of the lancet 18, whereat the thread is temporarily retained to establish a shed 30 of loop-forming warp threads WP.

A weft thread WF indicated by a dot is now inserted from one edge of the fabric F through the shed 30 by means of a weft inserter 31 disposed at one selvege side of the fabric F as shown in FIG. 2, and is caught by a latch needle 32 disposed at the other selvege side of the fabric F. The reed 15 is then actuated to beat up the weft thread WF, during which time the warp thread WP extending around the lancet 18 is advanced therealong past the fell 19 to be interlaced with the beaten weft thread WF, thereby forming warp pile loops P. The gate hook bars 25a then ascend to release the thread WP, and thus completing a first half cycle of the operation.

Figure 4B:
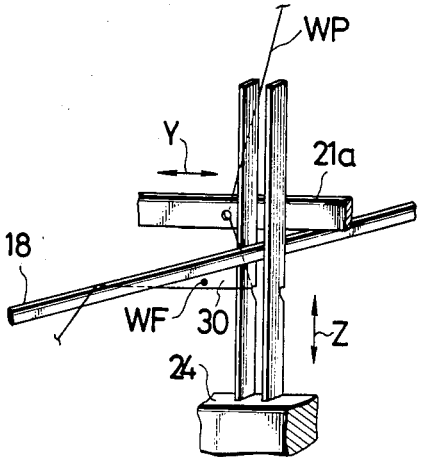

The second half cycle of the operation begins with movement of the guide bar 21a to the other or leftward direction in FIG. 4B to deflect the same thread WP to left-hand side of the lancet 18 and stops the position shown in FIG. 4B, whereupon the gate hook bars 25a are lowered again to capture the deflected thread at the guide recess 26 of left-hand gate hook bar 25a. Thereafter the thread WP is formed into a warp pile loop P in a similar manner to the first half cycle, and thus completing a second half cycle of nd hence one cycle of the operation.

This cycle is repeated by reciprocally moving the guide bar 21a and the gate hook bars 25 in the direction of the arrows Y, Z, respectively, thereby forming a multiplicity of warp pile loops on the fabric F. During this operation, the upper and lower sets of the ground warp threads are both moved by the heddles of the harness 14 to open and close their shed (not shown) to form the fabric F jointly with the weft thread WF in a wellknown manner.

Figure 5:
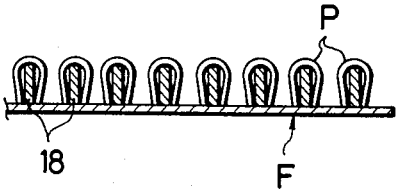
FIG. 5 is a vertical cross-sectional view of a surface fastener tape blank having loops formed on one side thereof with the lancets remaining therein.

Accordingly, the fabric F serving for instance as fastener tape with the warp pile loops P woven thereinto is progressively formed and withdrawn forwardly away from free ends of the lancets 18 with a portion of the loops engaged by the lancets 18. Some of the thus formed loops P are loosely engaging each lancets 18 therearound as shown in FIGS. 1 and 5.

Figure 6:
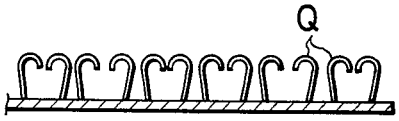
FIG. 6 is a vertical cross-sectional view of a male member of the surface fastener having hooks formed thereon.
Figure 7:
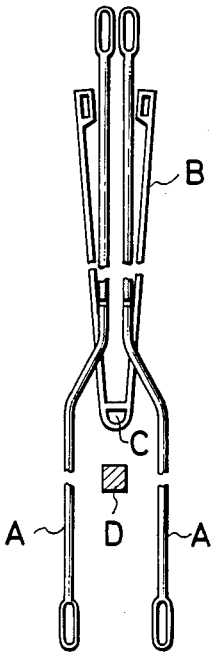
FIG. 7 PRIOR ART
FIG. 7 is a front elevational view of a conventional loop-forming doup or heddle unit.

FIG. 6 illustrates a male member or loop-carrying tape of the surface fastener including a multiplicity of hooks Q, which are formed by cutting partially away the warp pile loops P produced by the present loop-forming assembly.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A loop-forming assembly in a weaving machine for weaving a web of surface fastener tape having a multiplicity of warp pile loops formed of loop-forming warp threads on one side thereof, said assembly comprising:

(a) a lancet unit including a plurality of parallel spaced lancets each extending forwardly between and in parallel to a corresponding adjacent pair of ground warp threads beyond a cloth fell of the machine;

(b) a leno deflector extending transversely of said lancets between the fell and a harness of the machine, and including a plurality of eyelets through which the loop-forming warp threads are threaded respectively, said deflector being kept free from the lancets and reciprocable in a substantially axial direction thereof so as to deflect the course of the loop-forming threads alternately to one side and then to the other side of corresponding lancets respectively; and (c) a gate hook unit including a plurality of pairs of spaced gate hook bars disposed immediately downstream of said leno deflector and each pair extending vertically at the opposite sides of the corresponding one of said lancets such that said gate hook bars are kept free from the respective lancets and from said leno deflector, and each pair of gate hook-bars being vertically reciprocable in timed relation to said leno deflector to thereby capture the thus laterally deflected loop-forming warp thread by one of hook portions defined thereon to lower the thread alternately at one side and then at the other side of the corresponding lancet so as to pass the thread over the latter in a staggering fashion to thereby form of the warp pile loops.

2. A loop-forming assembly according to claim 1, said deflector including a pair of front and rear guide bars having two series of the eyelets through which alternate ones and the remaining ones of the loop-forming threads are threaded, respectively, while said gate hook unit including front and rear series of the paired gate hook bars disposed at the opposite sides of the corresponding lancets so that said front guide bars and said front series of the paired gate bars cooperatively work to pass said alternate ones of the threads over the corresponding lancets, and said rear guide bars and said rear series of the paired gate bars cooperatively work to pass said remaining ones of the threads over the corresponding lancets.

3. A loop-forming assembly according to claim 2, said front and rear guide bars being actuated to move at a time in the same direction.

4. A loop-forming assembly according to claim 2, wherein the loop-forming warp threads are devided into two sets, said front and rear guide bars each having first and second series of said eyelets for guidedly receiving said two sets of the threads respectively, and each of said front and rear series of said paired gate hook bars being also devided into first and second groups, such that said first series of eyelets and said first group of gate hook bars cooperatively work on one set of the threads, and such that said second series of eyelets and said second group of gate hook bars cooperatively work on the other set of the threads, thus forming two webs of surface fastener tapes at a time in a juxtaposed relationship.

5. A loop-forming assembly according to claim 2, all of said gate hook bars being connected to an unitary support block adapted to be actuated by a drive means.

6. A loop-forming assembly according to claim 1, all of said gate hook bars being connected to an unitary support block adapted to be actuated by a drive means.

7. A loop-forming assembly according to claim 1, each of said hook portions being in the form of a recess formed on the respective gate hook bar.

* * * * *